United States Patent [19]

Mowrey et al.

[11] 4,057,428

[45] Nov. 8, 1977

[54] PHOTOGRAPHIC ELEMENTS CONTAINING ANIONIC ORGANIC ACIDS

[75] Inventors: Rowland George Mowrey; Donald Arthur Smith; Richard Calvin Sutton, all of Rochester, N.Y.

[73] Assignee: Eastman Kodak Company, Rochester, N.Y.

[21] Appl. No.: 307,892

[22] Filed: Nov. 20, 1972

[51] Int. Cl.[2] ..... G03C 7/00; G03C 3/00; G03C 1/72

[52] U.S. Cl. ..... 96/74; 96/55; 96/114

[58] Field of Search ..... 96/74, 114, 55

[56] References Cited

U.S. PATENT DOCUMENTS

| | | | |
|---|---|---|---|
| 3,022,172 | 2/1962 | Ohba et al. | 96/114 |
| 3,251,689 | 5/1966 | Hallmig | 96/74 |
| 3,402,046 | 9/1968 | Zwick | 96/74 |
| 3,411,904 | 11/1968 | Becker | 96/74 |
| 3,411,911 | 11/1968 | Dykstra | 96/114 |
| 3,411,912 | 11/1968 | Dykstra | 96/114 |
| 3,591,382 | 7/1971 | Millikan | 96/74 |
| 3,676,141 | 7/1972 | Hara et al. | 96/74 |
| 3,765,891 | 10/1973 | Travis | 96/55 |

*Primary Examiner*—Jack P. Brammer
*Attorney, Agent, or Firm*—Carl O. Thomas

[57] ABSTRACT

Photographic elements are described which comprise a support having thereon at least one image dye-providing layer unit and at least one layer containing an immobile anionic organic acid having an equivalent weight based on acid groups of at least 70 and less than 800. In one embodiment, photographic elements of this invention can be contacted with a transition metal-ion complex such as a cobalt(III) ion complex before contact with a fixing bath and sufficient transition metal ion will be retained in the photographic element to bleach the silver in said element.

13 Claims, No Drawings

PHOTOGRAPHIC ELEMENTS CONTAINING ANIONIC ORGANIC ACIDS

This invention relates to photographic elements and processes for providing stable image records in photographic elements. In one aspect, this invention relates to improved photographic development processes wherein a photographic element is developed with a silver halide developing agent to form metallic silver, followed by contact with a silver halide fixing agent, the improvement comprising the use of a nondiffusing anionic organic acid, such as a polymeric compound containing anionic acid groups thereon, in the photographic element and contacting said element with a cobalt (III) ion complex having a coordination number of 6 before contact with said fixing agent, whereby sufficient transition metal-ion complex will be retained in the photographic element during the fixing steps to effect bleaching of a predominant amount of the silver. In another aspect, this invention relates to an improved method of processing photographic elements to obtain image dye records. In still another aspect, this invention relates to photographic elements comprising at least one image dye-providing layer unit containing silver halide at less than 50 mg. and preferably less than 30 mg. of silver/ft.$^2$ and a color coupler and at least one layer containing a nondiffusible anionic organic acid having an equivalent weight of at least 70 based on acid groups.

It is generally known in the prior art to bleach and then fix photographic elements after image dye records are produced by color development whereby the metallic silver is removed from the image record. Bleach-fix baths which combine the bleaching and fixing step are also known in the art, for example, as mentioned in U.S. Pat. No. 3,615,508 issued Oct. 26, 1971, and German Pat. No. 866,605. However, with most bleach baths, bleach-fix baths, etc., the activity of the bath is highly dependent on the concentration of active ingredients which diffuse into the photographic element as concentration gradients occur with bleach products and exhaustion of bleaching agents. Therefore, it would be desirable to provide better means for bleaching or bleach-fixing a metal from a photographic element. In some instances, it would also be desirable to concentrate the bleaching action on specific layers of the photographic element.

We have now found that certain anionic organic compounds can be incorporated in a photographic element which will permit sufficient bleaching agent to be imbibed into a photographic element before insertion of the photographic element into a fix bath whereby effective bleaching of the entire element or selective portions thereof can be easily carried out. Generally, the anionic organic compounds can be any immobile or ballasted organic compound containing anionic acid groups wherein the compound is present in sufficient concentration to provide ion-pairing sites for enough bleaching agent to bleach at least half of the developable silver in the silver halide layers associated therewith.

In one highly preferred embodiment, the anionic organic compound is a polymeric compound containing anionic acid groups thereon and preferably contains sulfonic acid groups thereon.

In another embodiment, the photographic element contains from 1 to 90 mg./ft.$^2$ and preferably 1 to about 50 mg./ft.$^2$ of silver and at least 1 equivalent weight of anionic organic acid based on acid groups per each equivalent of silver to be bleached and preferably at least 2 equivalents of anionic organic compound per each equivalent of silver.

In a highly preferred embodiment, the photographic elements of this invention comprise a support having thereon at least one image dye-providing layer unit containing a silver halide emulsion and an image dye-providing color coupler and at least one layer containing an immobile anionic organic acid in a concentration of at least 1 equivalent of organic acid based on acid groups per equivalent of silver in said photographic element.

In another preferred embodiment, this invention relates to photographic elements comprising a support having thereon at least one image dye-providing layer unit containing a silver halide emulsion at a coverage of less than 30 mg./ft.$^2$ and a photographic color coupler preferably in a stoichiometric excess based on developable silver, and at least one layer containing a nondiffusible anionic organic compound having acid groups thereof and an equivalent weight of at least 70 based on said groups. Generally, in a multicolor element two of the image dye-providing layers, such as the magenta and cyan image dye-providing layer units, contain silver halide at less than 30 mg./ft.$^2$, and a third image dye-providing layer unit such as the yellow image dye-providing layer unit can contain silver halide at less than 30 mg./ft$^2$, or if a coarse-grain emulsion is used for this layer it may be over 30 mg.ft.$^2$. In certain aspects of this invention, we have found that the incorporated anionic organic acids are most useful for retaining cobalt (III) ion complex in photographic elements containing a total coverage less than 90 mg./ft.$^2$ of light-sensitive silver halide emulsion (i.e., effective silver halide) based on silver, and preferably in elements containing less than 50 mg./ft.$^2$. Thus, photographic elements wherein the blue-sensitive silver halide emulsion is coated at a coverage of above 30 mg./ft.$^2$ can be effectively bleached by the cobalt(III) ion complex retained in the coating, but preferably in this instance the other silver halide emulsion layers comprise sufficiently lower silver halide coverages to bring the total element within the above ranges.

Generally, the photographic elements of this invention can be used in any process where the element containing a distribution of metallic silver is either contacted or is in contact with a solution containing a transition metal-ion complex such as a cobalt(III) ion complex and is subsequently contacted with a silver halide fixing agent. The immobile anionic compound containing acid groups thereon will retain the transition metal-ion complex to effect bleaching of the silver when contacted with the fixing agent.

We have found that the anionic organic compounds are generally quite efficient in retaining cobalt(III) complexes in a photographic element to carry them into a subsequent bath in large concentration. While it may be possible to imbibe and retain some cobalt (III) complex in a conventional photographic element, the concentration which can be retained is generally much lower and less uniform compared with the photographic elements of this invention.

In certain preferred embodiments the photographic elements of this invention are advantageously used in the amplification procedure described in U.S. Ser. Nos. 189,289 by Bissonette filed Oct. 14, 1971, or 256,071 by Travis filed May 23, 1972, now U.S. Pat. No. 3,765,891, both of which are incorporated herein by reference. In certain aspects of these processes, image dye can be produced by contacting a metallic silver image with a color-developing agent and a cobalt (III) ion complex to produce oxidized color developer which in turn reacts with color coupler to produce image dye. With the photographic elements of this invention, substantial quantitites of cobalt (III) ion complex will be retained in the element during the amplification process so that, when the element is inserted into the fix bath, silver will be bleached in the element.

In processes of this type, the amplification bath is substantially free of silver halide solvent or fixing agent, and conditions favor the amplification reaction without substantial oxidation of metallic silver, whereas when the element is inserted in the fix bath containing high concentrations of silver halide solvent, the conditions favor bleaching of silver.

Generally, the photographic elements in accordance with this invention contain immobile or nondiffusible compounds anionic organic compounds having acid groups thereon and having an equivalent weight of at least 70 and preferably between 100 and 300 based on said groups. The acid groups can generally be sulfinic acid groups, sulfonic acid groups, carboxylic acid groups, phosphonic acid groups, phosphoric acid groups, sulfate groups and the like or salts thereof, and preferably the alkali metal or alkaline earth salts thereof.

The anionic organic compounds of this invention are characterized as being water-soluble compounds, such as before incorporation into the photographic element. The term "water-soluble" is intended to mean that they are at least soluble in water at room temperature to provide at least a 3 percent and preferably at least a 5 percent by weight solution. However it is understood that the compounds can be crosslinked, hardened, etc., in the photographic element after coating to make them water-insoluble or substantially water-insoluble.

The term "anionic organic compound" as used herein refers to those compounds which are anionic under the conditions of general use in photography and preferably does not include amphoteric compounds. Preferably, the compounds exhibit anionic properties in the pH range of from about 3 to about 11. Moreover, the anionic organic compounds are nonproteinaceous compounds; for example, the term does not include substances such as gelatin which is amphoteric and proteinaceous. In still one other aspect, the anionic compounds have the equivalent weight as mentioned elsewhere herein, but can be further defined as those compounds having an equivalent weight of less than 800 based on acid groups and preferably less than 600.

In one preferred embodiment, we have found that water-soluble compounds containing acid groups thereon and having a molecular weight of at least 2000 and preferably at least 4000 will be nondiffusible when used in the photographic elements and will provide improvements in accordance with this invention. Typical compounds of this type include the acrylic polymers having acid groups thereon and comprise units of 3-methacryloyloxypropane-1-sulfonic acid, sodium salt; 3-acryloyloxypropane-1-sulfonic acid, sodium salt; sodium methacryloyloxyethyl sulfate; sodium methacrylate; and the like. The polymers can also be polystyrenes such as sulfonated polystyrene and the like.

In another embodiment, the water-soluble polymers of this invention can comprise units having sulfonic acid groups thereon and units having hardenable or crosslinking groups thereon, wherein the polymer can be crosslinked in situ after coating to provide a polymeric compound which is nondiffusing or immobile. Typical hardening groups which can be incorporated into polymers of this type include 2-acetoacetoxyethyl methacrylate, 2-[2-(methacryloyloxy)ethyl]isothiouronium methane sulfonate, N-cyanoacetyl-N'-methacryloyl hydrazine, N-methacryloyl-N'-glycyl hydrazine hydrochloride, 2-aminoethyl methacrylate hydrochloride and the like. Typical useful polymers of this type include poly(N-isopropylacrylamide—3-methacryloyloxypropane-1-sulfonic acid, sodium salt—2-acetoacetoxyethyl methacrylate); poly(N-isopropylacrylamide—3-methacryloyloxpropane-1-sulfonic acid, sodium salt —2-acetoacetoxyethyl methacrylate and the like, including polymers containing sulfonic acid groups disclosed in U.S. Pat. No. 3,459,790 by Smith issued Aug. 5, 1969, etc.

The anionic organic compounds of this invention can generally be incorporated in the photographic element in any layer, but they are preferably in a position where they will not deleteriously affect the development of the silver halide emulsion layers or in a position to achieve selective bleaching of certain layers. Where all three layers are to be bleached, the anionic acid compounds can be incorporated in a layer such as an underlayer wherein the cobalt (III) ion complex released during the fixing step will be in association with all layers in the element, especially if fixing is continued for a time.

In certain embodiments the anionic organic acid is located in association with only certain layers such as the outermost silver halide layers, wherein selective bleaching can take place. This feature is especially useful in photographic elements, such as elements containing an optical silver sound record in one layer, i.e., a sound-track formed by exposure and development of silver halide. The silver remaining in the pictorial image-recording areas can thus be selectively bleached after processing without substantial effect on the sound-track layer. Photographic elements of this type wherein the anionic organic compounds are useful are disclosed in U.S. Ser. Nos. 209,459 by Bevis et al, now U.S. Pat,. No. 3,705,803, 209,450 by Holtz, now U.S. Pat. No. 3,705,802, and 209,362 by Bello et al, now U.S. Pat. No. 3,705,799, all issued Dec. 12, 1972. In certain elements of this embodiment, the anionic organic acids can also be in other layers such as a underlayer wherein the bleaching action can be restricted primarily to specified layers.

The anionic organic acids are generally incorporated in the photographic elements in a concentration sufficient to retain transition metal-ion complex to bleach the silver formed during the development in the image dye-providing layer units. Since all of the silver halide is not developed and in some instances all the silver need not be removed, generally the anionic organic acid is used in the element at a concentration of at least 1 equivalent of anionic organic acid based on acid groups for each equivalent of silver and preferably at least 2 equivalents of anionic organic acid based on acid groups for each equivalent of silver. In certain embodiments, the anionic organic acid is incorporated in the photographic elements at a concentration of from about 25 to about 2000 mg./ft.$^2$, and preferably from 50 to about 600 mg./ft.$^2$.

In certain highly preferred embodiments the anionic organic compounds used in the photographic elements are those which do not substantially increase the viscosity of an aqueous gelatino dispersion. This characteristic is especially preferred where the layer is coated by extrusion coating, etc. Typical useful polymers of this type include polyvinyl sulfonic acid, sodium salt; poly-3-methacryloyloxypropane-1-sulfonic acid, sodium salt; and the like, having a low molecular weight such as those having an inherent viscosity of less than 0.7.

The fixing baths referred to herein generally include those baths used to fix silver halide from a photographic element. Baths of this type contain a silver halide solvent such as sodium thiosulfate, alkali metal thiocyanates, thioethers and the like. Silver halide solvents generally refer to those compounds which, when employed in an aqueous solution (60° C.), are capable of dissolving more than 10 times the amount (by weight) of silver chloride than that which can be dissolved by water at 60° C.

The bleaching agents which are retained by the anionic organic acid according to this invention are metal complexes, such as a transition metal complex, e.g., a Group VIII metal complex, or a complex of a metal of Series 4 of the periodic table appearing on pp. 54 and 55 of Lange's Handbook of Chemistry, 8th Edition, published by Handbook Publisher, Inc., Sandusky, Ohio, 1952. Such complexes feature a molecule having a metallic atom or ion. This metallic atom or ion is surrounded by a group of atoms, ions or other molecules which are generically referred to as ligands. The metallic atom or ion in the center of these complexes is a Lewis acid; the ligands are Lewis bases. Werner complexes are well-known examples of such complexes. The useful metal salts are typically capable of existing in at least two valent states Preferred metal complexes in accordance with this process have coordination numbers of 6 and are known as octahedral complexes. Cobalt complexes are especially useful in the practice of this invention. Most square planar complexes (which have a coordination number of 4) are rather labile, altough some Group VIII metal square planar complexes, particularly platinum and palladium square planar complexes, exhibit inertness to rapid ligand exchange.

A wide variety of ligands can be used with a metal ion to form suitable metal complexes. Nearly all Lewis bases (i,e., substances having an unshared pair of electrons) can be ligands in metal complexes. Some typical useful ligands include the halides, e.g., chloride, bromide, fluoride, nitrite, water amino, etc., as well as such common ligands as those referred to by Basolo and Pearson in *Mechanisms of Inorganic Reactions, a Study of Metal Complexes and Solutions,* 2nd Edition, 1967, published by John Wiley and Sons, p. 44. The lability of a complex is influenced by the nature of the ligands selected in forming said complex.

Particularly useful cobalt complexes have a coordination number of 6 and have ligands selected from the group consisting of ethylenediamine(en), diethylenetriamine(dien), triethylenetetraamine(trien), ammine ($NH_3$), nitrate, nitrite, azide, chloride, thiocyanate, isothiocyanate, water, carbonate and propylenediamine(tn). The preferred cobalt complexes comprise 1) at least 2 ethylenediamine ligands or 2) at least 5 ammine ligands or 3) 1 triethylenetetraamine ligand. Especially useful are the cobalt hexammine salts (e.g., the chloride, bromide, sulfite, sulfate, perchlorate, nitrite and acetate salts). Some other specific highly useful cobalt complexes include those having one of the following formulas: $[Co(HN_3)_5H_2O]X$; $[Co(NH_3)_5Co_3]X$; $[Co(NH_3)_5Cl]X$; $[Co(NH_3)_4CO_3]X$; $[Co(en)_3]X$; cis-$[Co(en)_2(N_3)_2]X$; trans-$[Co(en)_2Cl(NCS)]X$; trans-$[Co(en)_2(N_3)_2)X$; cis-$[Co(en)_2(NH_3)N_3]X$; cis-$[Co(en)_2Cl_2]X$; trans-$[Co(en)_2Cl_2]X$; $[Co(en)_2(SCN)_2]X$; $[Co(en)_2(NCS)_2]X$; $[Co(tn)_3]X$; $[Co(tn)_2(en)]X$; wherein X represents one or more anions determined by the charge neutralization rule.

With many complexes, such as cobalt hexammine, the anions selected can substantially effect the reducibility of the complex. The following ions are listed in the order of those which give increasing stability to cobalt hexammine complexes: bromide, chloride, nitrite, perchlorate, acetate, carbonate sulfite and sulfate. Other ions will also effect the reducibility of the complex. These ions should, therefore, be chosen to provide complexes exhibiting the desired degree of reducibility. Some other useful anions include chloride, nitrate, thiocyanate, dithionate and hydroxide.

The anionic organic acids referred to herein are believed to form ion pairs with the transition metal-ion complexes The metal-ion complexes contain anions which are generally referred to as outer sphere complexes ions or ion pairs and are to be distinguished from the ligands which are referred to as inner sphere complexes. It is believed that the acid groups of the high-molecular-weight compounds described herein form an ion pair, i.e., outer sphere complex or salt, with the metal-ion complex. The term "ion pair" is thus used herein to refer to the metal-ion complex with the high-molecular-weight compound containing acid groups thereon.

The photographic layers and other layers of a photographic element employed and described herein can be coated on a wide variety of supports. Typical supports include cellulose nitrate film, cellulose ester film, poly(vinyl acetal) film, polystyrene film, poly(ethylene terephthalate) film, polycarbonate film and related film or resinous materials, as well as glass, paper, metal and the like. Typically, a flexible support is employed, especially a paper support, which can be partially acetylated or coated with baryta and/or an $\alpha$-olefin polymer, particularly a polymer of an $\alpha$-olefin containing 2 to 10 carbon atoms such as polyethylene, polypropylene, ethylenebutene copolymers and the like. The color-providing layer units can be coated on the same side of the support or on opposite sides of the support where desired, such as when using a transparent film support.

The photographic elements of this invention, as defined above, comprise a support having thereon image dye-providing layer units. A multicolor photographic element comprises at least two of said image dye-providing layer units which each records light primarily in different regions of the light spectrum. The layer unit comprises a light-sensitive silver salt, which is generally spectrally sensitized to a specific region of the light spectrum, and has associated therewith a photographic color coupler. In certain preferred embodiments the color providing layer units are continuous layers which are effectively isolated from other layer units by barrier layers spacer layers, layers containing scavengers for oxidized developer and the like to prevent any substantial color contamination between the image dye-providing layer units. In other embodiments, the layer units are discontinuous layers comprising mixed packets which are effectively isolated from each other, as disclosed in Godowsky, U.S. Pat. No. 2,698,794 issued Jan. 4, 1954. The effective isolation of the layers units is known in the art and is utilized to prevent contamination in many commercial color products.

In one preferred embodiment, photographic elements of this invention comprise a support having thereon at least one image dye-providing layer unit containing a light-sensitive silver salt, preferably silver halide, having associated therewith a stoichiometric excess of coupler of at least 40 percent and at least preferably 70 percent. The equivalency of color couplers is known in the art; for example, a 4-equivalent coupler requires 4 moles of oxidized color developer, which in turn requires development of 4 moles of silver, to produce 1 mole of dye. Thus, for a stoichiometric reaction with silver halide, 1-equivalent weight of this coupler will be 0.25 mole. In accordance with this invention, the color image-providing unit comprises at least a 40 percent excess of the equivalent weight of image dye-providing color coupler required to react on a stoichiometric basis with the developable silver and preferably a 70 percent excess of said coupler. In one highly preferred embodiment, at least a 110 percent excess of the coupler is present in said dye image-providng layers based on silver. Preferably, the coupler-to-silver ratio is based on effective silver as defined herein. The ratio can also be defined as an equivalent excess with coupler-to-silver ratio of at least 1.4:1, and preferably at least 1.7:1 (i.e., 2:1 being a 100 percent excess). In certain preferred embodiments the photographic color couplers are employed in the image dye-providing layer units at a concentration of at least 3 times such as from 3 to 20 times, the weight of the silver in the silver halide emulsion. Weight ratios of coupler-to-silver coverage which are particularly useful are from 4 to 15 parts by weight coupler to 1 part by weight silver. Advantageously, the coupler is present in an amount sufficient to give a density of at least 1.7 and preferably at least 2.0. Preferably, the difference between the maximum density and the minimum density (which can comprise unbleached silver) is at least .6 and preferably at least 1.0.

It is realized that the density of the dye may vary with the developing agent combined with the respective coupler, and accordingly the quantity of coupler can be adjusted to provide the desired density. Preferably, each layer unit contains at least $1 \times 10^{-5}$ moles/ft.$^2$ of color coupler.

Advantageously, the photographic color couplers utilized are selected so that they will give a good neutral dye image. Preferably, the cyan dye formed has its major visible light abosrption between about 600 and 700 nm., the magenta dye has its major absorption between about 500 and 600 nm., and the yellow dye has its major absorption between about 400 and 500 nm.

The light-sensitive silver salts are generally coated in the color-providing layer units in the same layer with the photographic color coupler. However, they can be coated in separate adjacent layers as long as the coupler is effectively associated with the respective silver halide emulsion layer to provide for immediate dye-providing reactions to take place before substantial color-developer oxidation reaction products diffuse into adjacent color-providing layer units.

As used herein, the terms "photographic color coupler" and "image dye-producing color coupler" include any compound which reacts (or couples) with the oxidation products of primary aromatic amino developing agent on photographic development to form an image dye, and are nondiffusible in a hydrophilic colloid binder (e.g., gelatin) useful for photographic silver halide, and also those couplers which provide useful image dyes when reacted with oxidized primary aromatic amino developing agents such as by a coupler-release mechanism. The couplers can form diffusible or nondiffusible dyes. Typical preferred color couplers include phenolic, 5-pyrazolone and open-chain ketomethylene couplers. Specific cyan, magenta and yellow color couplers which can be employed in the practice of this invention are described in Graham et al, U.S. Pat. No. 3,046,129 issued Jan. 24, 1962, column 15, line 45, through column 18, line 51, which disclosure is incorporated herein by reference. Suchcolor couplers can be dispersed in any convenient manner, such as by using the solvents and the techniques described in U.S. Pat. No. 2,322,027 by Jelley et al issued June 15, 1943, or U.S. Pat. No. 2,801,171 by Fierke et al issued July 30, 1957. When coupler solvents are employed, the most useful weight ratios of color coupler to coupler solvent range from about 1:3 to 1:0.1. The useful couplers include Fischer-type incorporated couplers such as those described in Fischer, U.S. Pat. No. 1,055,155 issued Mar. 4, 1913, and particularly nondiffusible Fischer-type couplers containing branched carbon chains, e.g., those referred to in the reference cited in Frohlich et al, U.S. Pat. No. 2,376,679 issued May 22, 1945, column 2 lines 50–60. Particularly useful in the practice of this invention are the nondiffusible color couplers which form nondiffusible dyes.

In certain preferred embodiments the incorporated couplers in the layer units of this invention are water-insoluble color couplers which are incorporated in a coupler solvent which is preferably a moderately polar solvent. Typical useful solvents include tri-o-cresyl phosphate, di-n-butyl phthalate, diethyl lauramide, 2,4-diarylphenol, liquid dye stabilizers as described in an article entitled "Improved Photographic Dye Image Stabilizer-Solvent", *Product Licensing Index*, Vol. 83, pp. 26–29, March, 1971, and the like.

The term "nondiffusible" used herein as applied to anionic organic compounds, couplers and products derived from couplers has the meaning commonly applied to the term in color photography and denotes materials which for all practical purposes do not migrate or wander through photographic hydrophilic colloid layers, such as gelatin, particularly during processing in aqueous alkaline solutions. The same meaning is attached to the term "immobile". The terms "diffusible" and "mobile" have the converse meaning.

This invention may be further illustrated by the following examples.

The inherent viscosities as referred to herein are measured at a concentration of 0.25 g. of polymer/deciliter of solution at 25° C. using 0.1 N sodium chloride solution as solvent.

EXAMPLE 1:

Five photographic elements are prepared as follows:

Element A (control)

1. support;
2 layer containing silver chlorobromide emulsion at 10 mg. of Ag/ft.$^2$, 1-(2,4,6-trichlorophenyl)-3-{5-[α-(3-tert-butyl-4-hydroxyphenoxy)tetradecanamido]-2-chloroanilidino{-5-pyrazolone at 50 mg./ft.$^2$ dispersed 1:½ in di-n-butyl phthalate, and 250 mg./ft/$^2$ of gelatin.

Element B

Same as Element A except layer 2 additionally contains 200 mg./ft.$^2$ of sulfonated polystyrene (prepared by sulfonating polystyrene having a molecular weight of 60,000–100,000).

Element C

Same as Element A except layer 2 additionally contains 100 mg./ft.$^2$ of sulfonated polystyrene.

Element D

Same as Element A except layer 2 additionally contains 50 mg./ft.$^2$ of sulfonated polystyrene.

Element E (control)

Same as Element A except layer 2 contains 450 mg./ft.$^2$ of gelatin.

All of the coatings are hardened with formaldehyde. The coatings are then exposed on a sensitometer through a step wedge and processed at 30° C. as follows:

| | | |
|---|---|---|
| develop* | 1 | min. |
| $[Co(NH_3)_6]Cl_3$, 1.6 g. in 1 l. water | 1 | min. |
| wash | 1 | min. |
| fix** | 1 | min. |
| wash | 5 | min. |
| water | 500 | cc. |
| Elon | 20 | g. |
| sodium sulfite | 90 | g. |
| hydroquinone | 8 | g. |
| sodium carbonate | 52.5 | g. |
| KBr | 5.0 | g. |
| water to 1 liter | | |
| water | 600 | cc. |
| sodium thiosulfate | 240 | g. |
| sodium sulfite | 15 | g. |
| acetic acid - 28% | 48 | cc. |
| boric acid | 7.5 | g. |
| potassium alum | 15 | g. |
| water to 1 liter | | |

*Developer is Kodak D-19 which is as follows:
**Fix is Kodak F-5 which is as follows:

Upon analysis of the processed elements, Elements A and E retain substantially all of the developed silver while Elements B and C have all of the silver removed and Element D has only small amounts of silver remaining in the Dmax areas.

EXAMPLE 2

The Elements A-E of Example 1 are processed for 7 minutes at a temperature of 30° C. in color developer followed by the fixing, washing and drying per Example 1.

The color developer is as follows:

| | | |
|---|---|---|
| water | 800 | ml. |
| benzyl alcohol | 10 | ml. |
| $Na_2SO_3$ | 2 | g. |
| hydroxylamine sulfate | 2 | g. |
| NaBr | 0.5 | g. |
| NaCl | 0.5 | g. |
| 4-amino-N-ethyl-N-(2-methoxyethyl)-m-toluidine di-p-toluene sulfonic acid | 5.0 | g. |
| $Na_2CO_3$ (anhydrous) | 30.0 | g. |
| water to 1 liter; pH 10.1 at 75° F. (24° C.) | | |

Dye is formed in all elements and silver is present in all elements.

The process is repeated where the color developer additionally contains 1.6 g./l. of $[Co(NH_3)_6]Cl_3$. After fixing, substantially all of the silver is removed from Elements B, C and D, whereas Elements A and E retain substantial silver.

EXAMPLE 3

Separate elements are prepared similar to Element A of Example 1 wherein layer 2 additionally contains 100 mg./ft.$^2$ of poly ($\beta$-methacryloyloxypropane-1-sulfonic acid, sodium salt) (inherent viscosity of 0.9) and 100 mg./ft.$^2$ of poly(acrylic acid) respectively. The elements are processed by the procedure described in Example 1 and no silver is retained after processing.

EXAMPLE 4

The procedures described in Example 1 are repeated using a coarse-grained chlorobromide emulsion (about 5X larger) and the yellow dye-forming coupler $\alpha$-pivalyl-4-(4-benzyloxyphenylsulfonyl)phenoxy-2-chloro-5-[$\gamma$-(2,4-di-tert-amylphenoxy)butyramido]acetanilide at 100 mg./ft.$^2$ at a coating spread of 40 mg./ft.$^2$ of silver. At 200 mg./ft.$^2$ of polymer the silver is about 50% bleach-fixed. This is a function of the silver spread and grain size, but does demonstrate the effectiveness of the cobalt as a bleaching agent.

EXAMPLE 5

Separate elements are prepared as described in Example 1 wherein layer 2 contains the gelatin used as the peptizing agent and coupler dispersing agent at 50 mg./ft.$^2$, and all other gelatin is replaced respectively with 250 mg./ft.$^2$ of the polymers copoly(N-isopropylacrylamide—3-acryloyloxypropane-1-sulfonic acid, sodium salt—2-acetoacetoxyethyl methacrylate) (7:2:0.25 molar); copoly(N-isopropylacrylamide—3-methacryloxyoxypropane-1-sulfonic acid, sodium salt—2-acetoacetoxyethyl methacrylate) (7:7:1 molar); and copoly(N-isopropylacrylamide—3-methacryloyloxypropane-1-sulfonic acid, sodium salt—2-acetoacetoxyethyl methacrylate) (2:12:1 molar), which all have an inherent viscosity between 0.15→0.9.

The process of Example 1 is repeated on these elements and substantially all of the silver is removed.

EXAMPLE 6

A single-layer cyan coating is prepared which contains 5 mg./ft.$^2$ of silver and 120 mg./ft.$^2$ of the coupler:

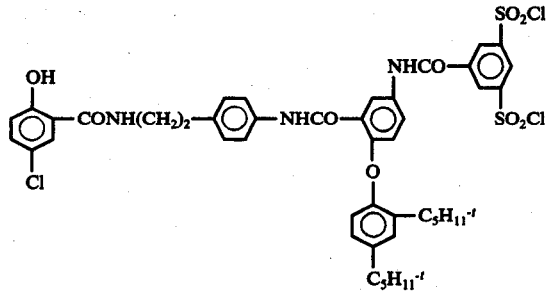

This coupler contains two sulfonic acid groups when coated and is present as the sodium salt.

One strip is exposed and processed in a check developer for 7 minutes and fixed for 2 minutes at 24° C. (75° F.). Another strip is developed similarly in a cobalt-containing developer and then fixed. Both strips are then washed for 5 minutes and dried. The strip processed in the cobalt developer contains no silver, demonstrating the operation of the invention by using the coupler as an ion-pairing species for the cobalt (III) hexammine.

EXAMPLE 7

Photographic elements are prepared as follows:

Element A (control)

1. support;
2 layer containing a silver chlorobromide emulsion at 15 mg./ft.$^2$ of silver, 200 mg./ft.$^2$ of gelatin, and 100 mg./ft.$^2$ of the coupler α-pivalyl-4-(4-benzyloxyphenylsulfonyl)phenoxy-2-chloro-5-[γ-(2,4-di-tert-amylphenoxy)butyramido]acetanilide.

Element B

Same as Element A but 200 mg./ft.$^2$ of sulfonated polystyrene are added to layer 2. The coating viscosity is very high, producing defects on coating.

Element C

Same as Element A except layer 2 contains 200 mg./ft.$^2$ of poly(vinyl sulfonic acid, sodium salt). The coating is of low viscosity, producing a uniform coating.

The elements are processed in the color developer containing $[Co(NH_3)6]Cl_3$ according to Example 2 and fixed, washed and dried according to Example 1. Elements B and C have no retained silver whereas substantial silver remains in Element A.

EXAMPLE 8

A solution of 40 g. of sodium 3-methacryloyloxypropane-1-sulfonate in 200 ml. of distilled water which has been sparged with nitrogen gas for 20 minutes is mixed with 160 g. of absolute ethanol and placed into a 500-ml. round-bottom flask and heated at 80° C. Ten ml. of 10% hydrogen peroxide is added and heating is continued for 4 hours. After cooling, the product is separated by pouring into tetrahydrofuran to produce an oily liquid which turns to a white solid after washing twice with methanol. The solid is dried for 48 hours at 50° C. under vacuum. The inherent viscosity is 0.5.

Analysis calculated for $C_7H_{11}NaO_5S$: C, 36.7; H, 4.8; S, 13.9; Na, 10.0, Found: C, 35.6; H, 5.1; S, 13.9; Na, 9.4.

A photographic element, Element D, is prepared similar to Element A of Example 7 except layer 2 also contains 200 mg./ft.$^2$ of the polymer produced next above. The element is compared with Elements B and C of Example 7 as follows:

| | Bleaching Effect | Gelatin Thickening |
|---|---|---|
| Element B | yes | yes |
| Element C | yes | no |
| Element D | yes | no |

It is apparent that good bleaching action can be attained with low viscosity polymers. Thus, in certain embodiments where high-speed coating is desired, low-viscosity polymers are preferably utilized.

EXAMPLE 9

A multilayer element containing a sound-track layer is prepared as follows:

1. support;
2. sound-track layer containing 25 mg.ft.$^2$ of silver halide based on silver and 20 mg./ft.$^2$ of gelatin;
3. layer containing 200 mg./ft.$^2$ of gelatin;
4. layer containing 200 mg./ft.$^2$ of a sulfonated polystyrene (prepared by sulfonating polystyrene having a molecular weight of from 60,000–100,000) and 200 mg./ft.$^2$ of gelatin;
5. image-recording layer containing 25 mg./ft.$^2$ of silver and 600 mg./ft$^2$ of gelatin.

Samples of the above element are fogged and developed in Kodak D-19 for 90 seconds. The coatings are then fixed for 5 minutes in Kodak F-5 and water-washed for 30 minutes. Next, two of the so-processed samples are treated in a $10^{-2}$ M $Co(NH_3)_6Cl_3$ solution for 1 and 5 minutes, respectively. Both samples are then washed for 30 minutes, fixed in Kodak F-5 for 5 minutes, washed for 30 minutes and air-dried. Samples are evaluated for silver retention by X-ray fluorescence analysis and from section photomicrographs.

| Time in $[Co(NH_3)_6]Cl_3$ Bath | Before Treatment* Ag° | After Treatment* Ag° | Amount Ag°* Removed |
|---|---|---|---|
| 0 minute | 45 mg./ft.$^2$ | — | — |
| 1 minute | — | 37 mg./ft.$^2$ | 8 mg./ft.$^2$ |
| 5 minutes | — | 11 mg./ft.$^2$ | 34 mg./ft.$^2$ |

*by X-ray fluorescence analysis

From the silver analysis and the section photomicrographs it appears that a 1-minute treatment in the $[Co(NH_3)6]Cl_3$ bath removes about half of the original 25 mg./ft.$^2$ in the image layer. It appears that in the 5-minute treatments all of the image silver is selectively bleached. In addition, some of the sound-track layer is also removed. Optimization of AgX coating levels, complex and treatment times would eliminate this unwanted bleaching in the sound-track layer.

EXAMPLE 10

Example 10 is identical Example 9 with the exception that a $10^{-2}$ M $[Co(NH_3)_5CO_3](NO_3)$ solution is used in place of the $10^{-2}$ M $[Co(NH_3)6]Cl_3$bath.

| Time in $[Co(NH_3)_5(CO_3)](NO_3)$ Bath | Before Treatment Ag° | After Treatment Ag° | Ag° Removed |
|---|---|---|---|
| 0 minute | 45 mg./ft.$^2$ | — | — |
| 1 minute | — | 28 mg./ft.$^2$ | 17 mg./ft.$^2$ |
| 5 minutes | — | 10 mg./ft.$^2$ | 35 mg./ft.$^2$ |

Again, the 1-minute treatment leaves some image silver whereas the 5-minute treatment removes all of the image silver and a slight amount of sound-track silver.

EXAMPLE 11

A photographic element containing a superposed soundtrack layer is prepared as follows:

1. support;
2. layer containing 200 mg./ft.$^2$ of sulfonated polystyrene (prepared by sulfonating polystyrene having a molecular weight between about 60,000–100,000) and 200 mg. of gelatin;
3. image-recording layer containing 35 mg./ft.$^2$ of silver halide emulsion based on silver and 600 mg./ft.$^2$ of gelatin;
4. layer containing 200 mg./ft.$^2$ of gelatin;
5. sound-track layer containing 35 mg./ft.$^2$ of silver halide based on silver and 200 mg. /ft.$^2$ of gelatin.

Samples are processed as in Example 9.

| Time in $[Co(NH_3)_6]Cl_3$ Bath | Before Treatment $Ag^o$ | After Treatment $Ag^o$ | Amount $Ag^o$ Removed |
|---|---|---|---|
| 0 minute | 69 mg./ft.$^2$ | — | — |
| 1 minute | — | 54 mg./ft.$^2$ | 15 mg./ft.$^2$ |
| 5 minutes | — | 31 mg./ft.$^2$ | 38 mg./ft.$^2$ |

The 1-minute treatment fails to remove all of the image silver. However, the 5-minute process removes all of the image silver and leaves the sound-track silver intact.

EXAMPLE 12

Multicolor photographic elements are prepared as follows:

Element A 1. paper support;
2 layer containing a blue-sensitive silver halide emulsion at 16 mg. silver/ft.$^2$, gelatin at 122 mg.ft.$^2$, and the color coupler α-pivalyl-4-(4-benzyloxyphenylsulfonyl)phenoxy-2-chloro-5-[γ-(2,4-di-tert-amylphenoxy)butyramido]acetanilide dispersed in di-n-butyl phthalate at 15 mg./ft.$^2$;
3. layer containing gelatin at 100 mg./ft.$^2$;
4 layer containing green-sensitive silver halide at 10 mg. of silver/ft.$^2$, gelatin at 132 mg./ft.$^2$, and the color coupler 1-(2,4,6-trichlorophenyl)-3-{-[α-(3-tert-butyl-4-hydroxyphenoxy)tetradecanamido]-2-chloroanilino}-5-pyrazolone at 25 mg./ft.$^2$ dispersed in tri-cresyl phosphate at 12.5 mg./ft.$^2$;
5. layer containing gelatin at 160 mg./ft.$^2$;
6. layer containing a red-sensitive silver halide emulsion at 6 mg. of silver/ft.$^2$, gelatin at 90 mg./ft.$^2$, and the color coupler 2-[α-(2,4-di-tert-amylphenoxy)-butyramido]-4,6-dichloro-5-methylphenol at 35 mg./ft.$^2$ dispersed in di-n-butyl phthalate at 17.5 mg./ft.$^2$;
7. layer containing gelatin at 100 mg./ft.$^2$.

Element B

This element is the same as Element A except it contains 50 mg./ft.$^2$ of sodium poly(vinyl sulfonate) in layer 2.

Element C

This element is the same as Element A except it contains 100 mg./ft.$^2$ of sodium poly(vinyl sulfonate) in layer 2.

Separate samples of the photographic elements are developed for 2 minutes in the color developer of Example 2 and the same developer containing 1.6 g./l. of $[Co(NH_3)6]Cl_3$, followed by fixing in Kodak F-5 fix for 1κ minutes and washing for 2 minutes.

The silver in Elements B and C is totally bleached when developed in the developer containing $[Co(NH_3)6]Cl_3$, whereas the same elements developed in the developer without $[Co(NH_3)6]Cl_3$ retain substantially all of the developed silver. Likewise, Element A processed by either procedure retains substantial silver with only about 10% or less of the silver removed in the process using the developer containing $[Co(NH_3)6]Cl_3$.

Although the invention has been described in considerable detail with particular reference to certain preferred embodiments thereof, variations and modifications can be effected within the spirit and scope of the invention.

We claim:

1. A photographic element comprising a support having thereon at least one image dye-providing layer unit containing a silver halide emulsion at a coverage of less than 30 mg./ft.$^2$ and a photographic color coupler, and at least one layer containing at least 25 mg./ft.$^2$ of a nondiffusible anionic organic polymeric compound having acid groups thereon and having an equivalent weight of at least 70 and less than 300 based on acid groups.

2. A photographic element according to claim 1 which contains at least one equivalent weight of anionic organic polymeric compound based on acid groups for each equivalent of silver.

3. A photographic element according to claim 1 wherein said image dye-providing layer unit contains a stoichiometric excess of said color coupler based on silver.

4. A photographic element according to claim 1 wherein said anionic organic compound is a polymeric compound having a molecular weight of at least 2000 and said acid groups are sulfonic acid groups.

5. A photographic element according to claim 1 wherein said anionic organic compound is a polymeric compound containing sulfonic acid groups and said polymeric compound is present in a concentration to provide at least one equivalent of said polymeric compound based on sulfonic acid groups for each equivalent of silver in said image dye-providing layer unit.

6. A photographic element according to claim 5 wherein said polymeric compound is located in said image dye-providing layer unit but adjacent the silver halide emulsion layer.

7. A photographic element according to claim 1 comprising at least three image dye-providing layer units.

8. A photographic element according to claim 7 wherein at least two of said image dye-providing units each contains silver halide at a concentration of less than 30 mg./ft.$^2$ and a stoichiometric excess of a color coupler based on silver.

9. A photographic element according to claim 7 wherein at least two of said image dye-providing layer units comprise a silver halide emulsion and at least a 40 percent stoichiometric excess of coupler based on silver.

10. A photographic element according to claim 1 which contains less than 90 mg./ft.$^2$ of silver halide emulsion based on silver.

11. A photographic element according to claim 7 which contains less than 50 mg./ft.$^2$ of silver halide emulsion based on silver.

12. A photographic element according to claim 7 wherein said anionic organic compound is a polymer containing units of 3-acryloyloxypropane-1-sulfonic acid, sodium salt.

13. A photographic element according to claim 7 of said anionic compound is a polymer comprising units ot 3-methacryloyloxypropane-1-sulfonic acid, sodium salt.

* * * * *

UNITED STATES PATENT AND TRADEMARK OFFICE

CERTIFICATE OF CORRECTION

PATENT NO. : 4,057,428

DATED : November 8, 1977

INVENTOR(S) : Mowrey, Smith and Sutton

It is certified that error appears in the above-identified patent and that said Letters Patent are hereby corrected as shown below:

Title page, column 1, penultimate line, "Hallmig" should read --Hellmig--.

Column 1, line 19, "steps" should read --step--.

Column 2, line 21, "thereof" should read --thereon--.

Column 3, line 20, after "compounds" (first occurrence), insert --,--.

Column 4, lines 13-14, "methacryloyloxpropane" should read --methacryloyloxypropane--; line 44, "3,705,802" should read --3,705,801--; and, line 66, after "embodiments", insert --,--.

Column 5, line 33, after "states", insert --.--; line 39, "altough" should read --although--; line 48, after "water", insert --,--; last line, that part of the first formula reading "$(HN_3)_5$" should read --$(NH_3)_5$--.

Column 6, line 61, after "layers" (first occurrence), insert --,--.

Column 7, line 22, "image-providng" should read --image-providing--; line 25, after "with", insert --a--; and, line 30, after "times" (first occurrence), insert --,--.

Column 8, line 25, "reference" should read --references--; line 26, after "2", insert --,--; line 30, after "embodiments", insert --,--; and line 66, "chloroanilidino}" should read --chloroanilino}--.

UNITED STATES PATENT AND TRADEMARK OFFICE

CERTIFICATE OF CORRECTION

PATENT NO. : 4,057,428

DATED : November 8, 1977

INVENTOR(S) : Mowrey, Smith and Sutton

It is certified that error appears in the above-identified patent and that said Letters Patent are hereby corrected as shown below:

Column 9, approximate line 38, "*Developer....follows:" should have been printed after approximate line 28 which begins with "wash"; approximate line 39, "**Fix....follows:" should have been printed after approximate line 33 which begins with "water".

Column 11, penultimate line, "20" should read --200--.

Column 12, line 5, after "silver", insert --halide emulsion based on silver--.

Column 13, line 54, "1k" should read --1-1/2--.

Column 14, line 51, "1" should read --7--; line 61, "7 of" should read --7 wherein--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*